US008739903B2

(12) United States Patent
Denoix et al.

(10) Patent No.: US 8,739,903 B2
(45) Date of Patent: Jun. 3, 2014

(54) ADJUSTABLE DRILL BIT

(75) Inventors: Henri Denoix, Chatenay Malabry (FR); Pierre-Jèrõme Acquaviva, La Garde (FR); Eric Lavrut, Yokohama (JP)

(73) Assignee: Schlumberger Technology Corporation, Sugar Land, TX (US)

( * ) Notice: Subject to any disclaimer, the term of this patent is extended or adjusted under 35 U.S.C. 154(b) by 231 days.

(21) Appl. No.: 12/744,332

(22) PCT Filed: Nov. 20, 2008

(86) PCT No.: PCT/EP2008/009796

§ 371 (c)(1),
(2), (4) Date: Aug. 13, 2010

(87) PCT Pub. No.: WO2009/065575

PCT Pub. Date: May 28, 2009

(65) Prior Publication Data

US 2010/0303570 A1 Dec. 2, 2010

(30) Foreign Application Priority Data

Nov. 23, 2007 (GB) ..... 0722997.4

(51) Int. Cl.
*E21B 10/62* (2006.01)

(52) U.S. Cl.
USPC ..... 175/381; 175/382

(58) Field of Classification Search
USPC ..... 175/381, 382, 383, 384
See application file for complete search history.

(56) References Cited

U.S. PATENT DOCUMENTS

| | | | | |
|---|---|---|---|---|
| 2,647,737 | A * | 8/1953 | Stephens | 299/102 |
| 4,133,399 | A * | 1/1979 | Herrmann | 175/384 |
| 4,199,035 | A | 4/1980 | Thompson | |
| 4,553,615 | A | 11/1985 | Grainger | |
| 4,654,947 | A | 4/1987 | Davis | |
| 5,279,375 | A | 1/1994 | Tibbitts et al. | |
| 6,142,250 | A * | 11/2000 | Griffin et al. | 175/381 |
| 6,745,858 | B1 * | 6/2004 | Estes | 175/384 |
| 2002/0020565 | A1 | 2/2002 | Hart et al. | |
| 2008/0135292 | A1 * | 6/2008 | Sihler et al. | 175/27 |

FOREIGN PATENT DOCUMENTS

| | | |
|---|---|---|
| EP | 1777365 | 4/2007 |
| GB | 2428713 | 2/2007 |
| JP | 2002250194 A | 9/2002 |
| WO | 2007044791 | 4/2007 |

OTHER PUBLICATIONS

Search report for the equivalent GB patent application No. 0722997.4 issued on Mar. 3, 2008.

* cited by examiner

*Primary Examiner* — William P Neuder
(74) *Attorney, Agent, or Firm* — Stephanie Chi; Jody DeStefanis

(57) ABSTRACT

A rotary drill bit is provided comprising a bit body, which includes a connecting portion for connection to a conveyance and a drilling portion. The drilling portion includes a plurality of cutting elements each having at least one cutting surface, the drilling portion being operable in at least two different drilling orientations, and the drilling surface being rotatable in one of two opposing directions, being a first direction and an opposing second direction.

18 Claims, 2 Drawing Sheets

ADJUSTABLE DRILL BIT

CROSS-REFERENCE TO RELATED APPLICATIONS

The present application is based on and claims priority to GB Application No. 0722997.4, filed 23 Nov. 2007; and International Patent Application No. PCT/EP2008/009796, filed 20 Nov. 2008. The entire contents of each are herein incorporated by reference.

TECHNICAL FIELD

This invention relates to a rotary drill bit. More particularly, the invention relates to an adjustable rotary drill bit for use down-hole in a well.

BACKGROUND ART

Drill bit design has a long history and several improvements and new concepts have been developed to improve the performance of drill bits used down-hole in wells, such as oil wells or gas wells, and to adapt different drill bit characteristics to different drilling environments and to different drilling requirements while down-hole in a well.

One of the issues with existing design of drill bits is the need to trip the whole drill string or drilling apparatus out of the hole in order to change the bit when drilling environments or the drilling requirements change during drilling. This is an expensive exercise as drilling activities have to be stopped for a period of time while this is being done. The need to trip the whole drill string or drilling apparatus also exists when the cutting elements on the bit are damaged or lost in use and they need to be replaced for efficient drilling to continue.

Despite significant development over the years, drill bit designs have remained concentrated on the solid architecture of the drill bit. There were various reasons for this, such as; previously drill bits used in wells were designed to be used connected with tubes to the surface, with poor control of drilling conditions. Also when drilling with tubes connected to surface, it was difficult to control the force applied to the drill bit and the design of the drill bit always then included a large safety coefficient to provide resistance to the very high loads that were possible. In addition, when drilling with tubes connected to the surface of a well, it was not practical to implement control of actuators mounted on the drill bit. Further, when drilling with tubes connected to surface, it was not possible to rotate the drill bit in both directions for drilling. This was due to the tube being made with a thread in one direction that could take a torque load in that one direction but could not take a torque load in the other direction without a risk of the thread breaking.

A steerable drilling system is described in GB 2428713 A as having a drill bit which includes one or more moveable components. The movable component is shown as being mounted on a blade of the drill bit, and on which is provided a plurality of cutting elements. The advantages which the current invention has over the drilling system and drill bit as disclosed in that document, is that the rotary drill bit of the present invention may be used in the changing drilling environments and drilling requirements where conventional drilling with pipes are used. The current invention provides for improved steering, vibrations to ease cuttings, milling, and adaption to change in rocks, et cetera, in environments where the stresses on the drill bit are very high and where access to control over the drill bit are limited. Further, the current invention is operable in at least two different drilling orientations and the drilling surface is rotatable in one of two opposing directions, allowing for efficient adaption to any changes in the drilling environment.

One of the advantages of the current invention is that the drill bit characteristics may be adapted to changes in the drilling environment in a well or to changes in the drilling requirements in a well, without having to pull the drilling equipment out of the well. The adaptations made to the characteristics of the drill bit may also have the advantage that they improve the performance of the drill bit in a changing drilling environment or under changing drilling requirements. The drill bit may be used in more than one rotary direction and orientation of the cutting elements and the cutting surfaces on the cutting elements may all be adjusted according to what is required in the particular circumstances without having to remove the drilling equipment from the drilling area. Further, the drill bit may be adapted remotely.

Another advantage of the current invention is that when used in open mining the drill bit characteristics may be remotely adapted to changes in the drilling environments and changing drilling requirements.

DISCLOSURE OF INVENTION

A first aspect of the invention provides a rotary drill bit comprising:

- a bit body which includes a connecting portion for connection to a conveyance and a drilling portion;
- the drilling portion including a drilling surface having a plurality of cutting elements each having at least one cutting surface, the drilling portion being operable in at least two different drilling orientations; and
- the drilling surface being rotatable in one of two opposing directions, being a first direction and an opposing second direction.

There is preferably at least a first cutting surface and a second cutting surface on each cutting element. The first cutting surfaces may be used for drilling when the drilling portion is rotated in a first direction. The second cutting surfaces may be used when the drilling portion is rotated in a second direction.

In one form of the invention an adjustment means is located on each cutting element for adjusting the configuration of the cutting element while in use.

According to yet a further aspect of the invention the positional orientation of the cutting elements in relation to the drilling surface of the drilling portion is adjustable.

One example of the positional orientation of a cutting element being adjustable is that the height of the cutting surface above the surface of the drilling portion may be adjustable. Another example of the physical orientation of a cutting element is that the angular displacement between a cutting surface and the surface of the drilling portion may be adjustable.

The adjustment means may be remotely controlled.

Preferably the rotary drill bit is used with electronically controlled drilling equipment, and the cutting elements are electronically adjustable.

The first cutting surface and the second cutting surface of the cutting elements are preferably of the PDC type.

Preferably the rotary drill bit is used with conventional drill pipes.

Typically the drill bit may be configurable downhole in response to changing conditions in the downhole environment.

BRIEF DESCRIPTION OF FIGURES IN THE DRAWINGS

MODE(S) FOR CARRYING OUT THE INVENTION

This invention involves the integration of apparatus and features in a rotary drill bit that allows modification of the drilling characteristics of the bit while in use during a drilling operation and that may also increase its durability. The modification of the rotary drill bit characteristics and performances are obtained by changing the direction of rotation, by auto-adapting mechanisms and by direct control of adjusting actuators on the rotary drill bit. Typically the drill bit is configurable downhole in response to changing conditions that are encountered in the downhole environment.

Figure 1:
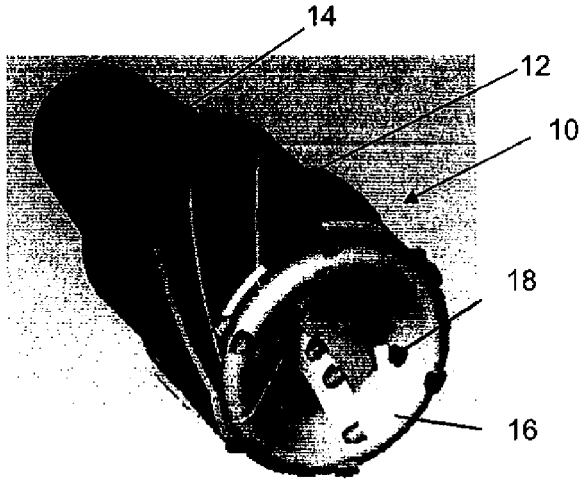
FIG. 1 shows a schematic isometric view of one embodiment of a rotary drill bit according to the invention.

An embodiment of a rotary drill bit according to the invention is shown in FIG. 1, in which a rotary drill bit 10 is shown to comprise a bit body 12. Rotary drill bit 10 finds particular use in drilling operations down-hole in wells, such as, oil or gas wells. The bit body 12 has a shank 14 for connection to a conveyance such as a wire in wireline drilling, or a drill string used down-hole in a well. Bit body 12 also includes a drilling portion 16, on which are located a plurality of cutting elements 18.

Characteristics of cuttings elements 18 disposed on the drill bit 10 are designed to present different cutting characteristics depending on the direction of rotation of rotary drill bit 10.

Changes in the drilling characteristics of rotary drill bit 10 are obtained by modifying the cutting elements 18 or modifying the configuration of the cutting elements 18 located on drill the bit 10. When the configuration of the cutting elements is changed, the drilling characteristics of rotary drill bit 10 may be modified by reversing the direction of rotation of drill bit 10.

Figure 2:
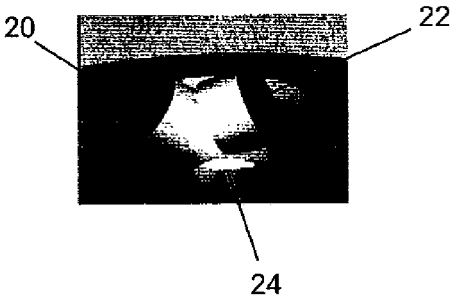
FIG. 2 shows a schematic isometric view of a first position of a cutting element of the rotary drill bit.

As shown in FIG. 2, each cutting element 18 has two cutting surfaces, namely a first cutting surface 20 and a second cutting surface 22. The cutting surfaces 20, 22 on cutting elements 18 are preferably of polycrystalline diamond compact (PDC) material, but may also be of other types of material if required. Optionally, one of the cutting surfaces may be of one type of material, such as PDC, and the other cutting element may be of another type of material. Alternatively, other characteristics making up the configuration of the cutting surfaces 20, 22 themselves may be changed, such as, changing their diameters, chamfer shape or overall dimensions.

Figure 3:
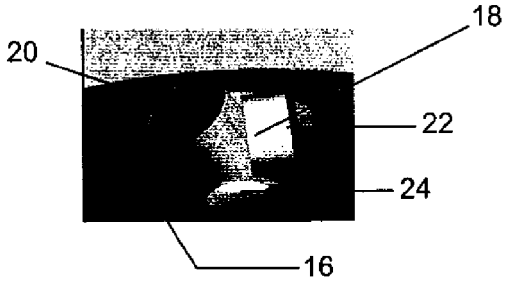
FIG. 3 shows a schematic isometric view of a second position of the cutting element of the rotary drill bit.

As shown in FIGS. 2 and 3, each cutting element 18 is located on the drilling portion 16 by means of a pivot mechanism 24. Pivot mechanism 24 is activated by an electronically controlled actuator (not shown). Each pivot mechanism 24 and actuator may be used to change the back or side rake angles of the cutting element 18 to which it is attached.

The actuator on each cutting element 18 may also enable an up of down movement of each cutting element, thus changing the height of each cutting surface 20, 22 above the surface of the drilling portion 16.

Figure 4:
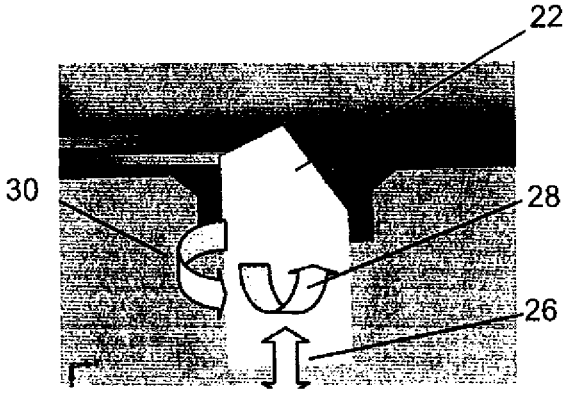
FIG. 4 shows a schematic partial side view of a cutting element of the rotary drill bit.

As shown in FIG. 4, the drilling characteristics of drill bit 10 may be modified by changing the positions in the directions shown by arrow 26 and the directions, shown by arrows 28 and 30, of the cutting elements 18. Actuator mechanisms that are used to change the position of the cutting elements 18 are preferably, but not exclusively made with piezoelectric motors and magnetostrictive motors. These motors are activated with electrical wires connected to the control module of the drilling system to which the drill bit 10 is attached. Optionally cutting elements 18 may be fully retracted into the drilling portion 16 by actuator mechanisms so as to allow other cutting elements to become active or available for use.

In another aspect of the invention, the position of the cuttings elements 18 may be modified depending on their angle of displacement with the high side of the well with mechanisms as described above. This feature is used to control the directional or steering characteristics of the drill bit 10.

The cutting elements 18 may also be mounted on the drill bit 10 by actuators that are used to produce vibrating movements in the directions of arrow 26, shown in FIG. 4, of the cutting elements 18. These movements facilitate drilling in areas with hard rock that requires high levels of strength to be used. The frequencies of the vibrations produced by the actuators may be adjusted depending on the characteristics of the rocks encountered while drilling.

The configuration of the structure of the cutting elements 18 may be made to optimize drilling efficiency of the drill bit to mill casing by reversing the direction of rotation or by modifying the position of the cutting elements with actuators mounted between the bit and the cutting element.

The drilling characteristics of drill bit 10 which may be modified are, for example, those that are considered for a given environment. These include, for example, fast rate of penetration for different type of rocks with high efficiency, hole quality (constant diameter, surface finish), hole straightness, the ability to keep the hole in a predefined track or to reach a given spatial target, the ability to drill a hole with a given radius of curvature, the management of cuttings, the lifespan of the drill bit, and the ability to mill or drill through metallic tubing or casings.

The drilling characteristics of drill bit 10 that allow these performances to be maintained for various drillings environments may also be modified. These include, for example, weight on bit, speed of rotation, lateral force on bit, bottom hole assembly on top of drill bit 10, tube assembly to the surface of a well, and hydraulic power.

The drilling characteristics of drill bit 10 which may be modified are also those that are used to maintain different drilling requirements. These include, for example, different types of rocks and the ability to open hole in metal tubing/casing, the types of target well hole geometry, and the types of environmental conditions such as temperature and pressure.

In another embodiment of the invention the cutting characteristics of drill bit 10 may be the same in both directions of rotation but a change of direction of rotation may be used merely to increase the lifespan of the drill bit by presenting two cutting surfaces that wear independently from each other. In this orientation, one cutting surface is used during rotation of the drill bit 10 in one direction and the other cutting surface is used during rotation of the drill bit 10 in the other direction.

The characteristics of cutting elements 18 in the drill bit 10 may also be modified by a change in the directional orientation of the cutting elements 18, and the frictional forces applied to the cutting elements 18 may also be changed when reversing the direction of rotation of the drill bit 10, with the cutting elements being mounted on a pivot mechanism 24, as shown in FIGS. 2 and 3.

The changes to the characteristics of drill bit 10 may also be achieved by simultaneously using different features of the drill bit 10, as described above.

Rotary drill bit 10 is typically used with conventional drill pipes, which are used in the more demanding drilling environments where there are large stresses placed on the drilling apparatus, specifically the drill bit, and where the conditions in the environment downhole are very changeable.

While the present invention has been described with respect to a limited number of embodiments, those skilled in the art having the benefit of this disclosure, will appreciate numerous modifications and variations therefrom. It is intended that the appended claims cover all such modifications and variations as fall within the true spirit and scope of this present invention.

What is claimed is:

1. A rotary drill bit comprising:

a bit body having a connecting portion for connection to a conveyance and a drilling portion;

the drilling portion including a drilling surface having a plurality of cutting elements, each cutting element having at least a first cutting surface and a second cutting surface, the drilling portion being operable in at least two different drilling orientations; and the drilling surface being rotatable in two opposing directions comprising a first direction and a second direction opposite from the first direction.

2. A rotary drill bit as claimed in claim 1, wherein the first cutting surface is used for drilling when the drilling portion is rotated in a first direction.

3. A rotary drill bit as claimed in claim 1, wherein the second cutting surface is used when the drilling portion is rotated in a second direction.

4. A rotary drill bit as claimed in claim 1, wherein an adjustment means is located on each cutting element for adjusting the configuration of the cutting element while in use.

5. A rotary drill bit as claimed in claim 4, wherein the positional orientation of the cutting elements in relation to the surface of the drilling portion is adjustable.

6. A rotary drill bit as claimed in claim 4, wherein the height of the cutting surface above the surface of the drilling portion is adjustable.

7. A rotary drill bit as claimed in claim 4, wherein the angular displacement between a cutting surface and the surface of the drilling portion is adjustable.

8. A rotary drill bit as claimed in claim 4, wherein the adjustment means is remotely controlled.

9. A rotary drill bit as claimed in claim 1, wherein the rotary drill bit is used with electronically controlled drilling equipment, and the cutting elements are electronically adjustable.

10. A rotary drill bit as claimed in claim 1, wherein at least a portion of the cutting surfaces on the cutting elements are of the PDC type.

11. A rotary drill bit as claimed in claim 1, wherein the drill bit is used with conventional drill pipes.

12. A rotary drill bit as claimed in claim 1, wherein the drill bit is configurable downhole in response to changing conditions in the downhole environment.

13. A method, comprising:

rotating a rotary drill bit in a first rotational direction within a well to extend the well, wherein the rotary drill bit comprises a plurality of cutting elements, wherein:

at least one of the plurality of cutting elements comprises first and second cutting surfaces; and rotating the rotary drill bit in the first rotational direction extends the well by removing material with the first cutting surface of the at least one of the plurality of cutting elements; and rotating the rotary drill bit in a second rotational direction within the well to further extend the well, wherein the first and second rotational directions are substantially opposite, and wherein rotating the rotary drill bit in the second rotational direction extends the well by removing material with the second cutting surface of the at least one of the plurality of cutting elements.

14. The method of claim 13 further comprising conveying the rotary drill bit within the well via one of:

a wireline; and a drill string.

15. The method of claim 13 further comprising modifying at least one of the plurality of cutting elements after rotating the rotary drill bit in the first rotational direction but before rotating the rotary drill bit in the second rotational direction.

16. The method of claim 15 wherein modifying at least one of the plurality of cutting elements comprises changing an angle of at least one of the plurality of cutting elements.

17. The method of claim 15 wherein modifying at least one of the plurality of cutting elements comprises changing a height of at least one of the plurality of cutting elements.

18. The method of claim 15 wherein modifying at least one of the plurality of cutting elements comprises retracting at least one of the plurality of cutting elements into the rotary drill bit.

* * * * *